US009562371B2

(12) United States Patent
McCaslin et al.

(10) Patent No.: US 9,562,371 B2
(45) Date of Patent: Feb. 7, 2017

(54) INTENSIVE CARE UNIT DOOR CONTROL SYSTEM

(71) Applicant: ASSA ABLOY ENTRANCE SYSTEMS AB, Landskrona (SE)

(72) Inventors: Michael McCaslin, Easton, PA (US); Jeffrey A. Wolfe, Matthews, NC (US)

(73) Assignee: ASSA ABLOY ENTRANCE SYSTEMS AB, Landskrona (SE)

( * ) Notice: Subject to any disclaimer, the term of this patent is extended or adjusted under 35 U.S.C. 154(b) by 234 days.

(21) Appl. No.: 14/231,480

(22) Filed: Mar. 31, 2014

(65) Prior Publication Data

US 2014/0208651 A1 Jul. 31, 2014

Related U.S. Application Data

(63) Continuation-in-part of application No. 13/016,031, filed on Jan. 28, 2011, now abandoned, and a (Continued)

(51) Int. Cl.

| | |
|---|---|
| ***E05B 15/02*** | (2006.01) |
| ***E05B 47/00*** | (2006.01) |
| ***E05B 63/24*** | (2006.01) |
| ***E05B 65/08*** | (2006.01) |
| ***E05B 65/10*** | (2006.01) |

(Continued)

(52) U.S. Cl.

CPC ..... *E05B 47/0046* (2013.01); *E05B 63/244* (2013.01); *E05B 63/248* (2013.01); *E05B 65/08* (2013.01); *E05B 65/0811* (2013.01); *E05B 65/108* (2013.01); *E05F 15/70* (2015.01); *E05F 15/73* (2015.01); *E05Y 2400/354* (2013.01); *E05Y 2400/42* (2013.01);

(Continued)

(58) Field of Classification Search

CPC ..... G06F 19/3418; G06F 19/345; A61B 2505/01; A61B 5/0006; A61B 5/0022; H04M 3/5116

USPC ..... 292/340; 49/24, 13, 124, 149, 360, 368; 707/999; 340/539.1; 600/300, 301

See application file for complete search history.

(56) References Cited

U.S. PATENT DOCUMENTS

| | | | |
|---|---|---|---|
| 3,668,682 | A | 6/1972 | Barbee et al. |
| 3,729,770 | A | 5/1973 | Lasier |

(Continued)

FOREIGN PATENT DOCUMENTS

| | | |
|---|---|---|
| DE | 9001993 | 4/1990 |
| DE | 4208216 | 9/1993 |

(Continued)

OTHER PUBLICATIONS

International Search Report and Written Opinion for International (PCT) Patent Application No. PCT/EP2012/050640 mailed May 24, 2012, 7 pages.

(Continued)

*Primary Examiner* — Mark Williams

(74) *Attorney, Agent, or Firm* — Sheridan Ross P.C.

(57) ABSTRACT

The present invention relates to doors for intensive care units and more particularly to an intensive care unit door control system. In particular, the invention relates to a door management system for an intensive care unit comprising at least one control unit configured to receive signals from at least one external device and to control the opening and closing of the automatic intensive care unit doors based on the received signals.

18 Claims, 10 Drawing Sheets

Related U.S. Application Data continuation-in-part of application No. 13/016,060, filed on Jan. 28, 2011, now abandoned.

(51) Int. Cl.
*E05F 15/70* (2015.01)
*E05F 15/73* (2015.01)

(52) U.S. Cl.
CPC ... *E05Y 2800/102* (2013.01); *E05Y 2800/113* (2013.01); *E05Y 2900/132* (2013.01)

(56) References Cited

U.S. PATENT DOCUMENTS

| | | | | |
|---|---|---|---|---|
| 3,751,086 | A | 8/1973 | Geringer | |
| 3,934,306 | A | 1/1976 | Farris | |
| 4,034,437 | A | 7/1977 | Robertson et al. | |
| 4,275,383 | A * | 6/1981 | White | G08B 3/10 340/286.07 |
| 4,563,625 | A | 1/1986 | Kornbrekke et al. | |
| 4,999,607 | A | 3/1991 | Evans | |
| 5,100,186 | A | 3/1992 | Nordvall | |
| 5,581,944 | A * | 12/1996 | Kornbrekke | E05F 15/42 49/27 |
| 5,782,036 | A | 7/1998 | Bertieri et al. | |
| 5,990,579 | A | 11/1999 | Ricci | |
| 6,218,939 | B1 | 4/2001 | Peper | |
| 6,221,010 | B1 | 4/2001 | Lucas | |
| 6,225,904 | B1 | 5/2001 | Jaffe et al. | |
| 6,525,659 | B2 | 2/2003 | Jaffe et al. | |
| 7,128,350 | B2 | 10/2006 | Eckerdt | |
| 7,136,711 | B1 | 11/2006 | Duncan et al. | |
| 7,322,621 | B2 | 1/2008 | Liao | |
| 7,331,141 | B2 | 2/2008 | Gilchrist | |
| 7,540,542 | B2 | 6/2009 | Geringer et al. | |
| 7,568,745 | B2 | 8/2009 | Brose et al. | |
| 2005/0010649 | A1 | 1/2005 | Payne et al. | |
| 2009/0324444 | A1 | 12/2009 | Stratmann | |
| 2011/0016971 | A1 | 1/2011 | Yulkowski et al. | |
| 2012/0192490 | A1 | 8/2012 | McCaslin | |
| 2012/0192493 | A1 | 8/2012 | Wolfe | |

FOREIGN PATENT DOCUMENTS

| | | |
|---|---|---|
| DE | 19631665 | 2/1998 |
| DE | 102005001320 | 7/2006 |
| GB | 18689 | 0/1914 |
| GB | 2276190 | 9/1994 |
| JP | H03-228988 | 10/1991 |
| JP | H07-283766 | 10/1995 |
| JP | H07-293111 | 11/1995 |
| JP | 2000-096940 | 4/2000 |
| JP | 2006-230893 | 9/2006 |
| JP | 2008-245787 | 10/2008 |
| WO | WO 87/07670 | 12/1987 |
| WO | WO 93/09319 | 5/1993 |

OTHER PUBLICATIONS

International Search Report and Written Opinion for International (PCT) Patent Application No. PCT/EP2012/050639 mailed May 29, 2012, 9 pages.
Official Action for U.S. Appl. No. 13/016,060 mailed Apr. 29, 2013, 8 pages.
Official Action for U.S. Appl. No. 13/016,060 mailed Oct. 29, 2013, 9 pages.
Official Action for U.S. Appl. No. 13/016,031 mailed Mar. 27, 2013, 6 pages.
Official Action for U.S. Appl. No. 13/016,031 mailed Aug. 2, 2013, 6 pages.
Official Action for U.S. Appl. No. 13/016,031, mailed Mar. 4, 2014 7 pages.

* cited by examiner

INTENSIVE CARE UNIT DOOR CONTROL SYSTEM

CROSS-REFERENCE TO RELATED APPLICATIONS

The present application is a continuation-in-part of U.S. application Ser. No. 13/016,031 titled "Automated Strike," filed Jan. 28, 2011, and is a continuation-in-part of U.S. application Ser. No. 13/016,060 titled "Intensive Care Unit Door Control System," filed Jan. 28, 2011, the entire contents of which are incorporated herein by reference in their entirety.

TECHNICAL FIELD

The present invention relates to doors for intensive care units and more particularly to an intensive care unit door control system. The invention also relates to a method for operating the doors in an intensive care unit.

BACKGROUND

An intensive care unit is a hospital unit staffed and equipped to provide intensive care. An increase of requirements on doors used in intensive care units has recently been seen. One requirement is that a intensive care unit door is trackless, that is, the door does not have any threshold or similar arrangement across the door opening, so as to minimize collection of bacteria and various types of debris, and such that patients and intensive care unit equipment can be easily moved through the door opening. Another requirement is that the door should have a UL air leakage rated seal around its perimeter, in order to create a seal that serves to minimize smoke or germ contamination inside the room by reducing air leakage and infiltration.

Furthermore, the door should have a positive latch, that is, the door should be possible to secure to the door jamb or opposing door, so that the door cannot open by itself after the door has been closed. A positive latch is also required to have and a handle that protrudes from the door face.

However, these strict requirements may cause problems to the staff in the hospitals in several situation, when a fast opening of the door is required e.g. due to an emergency message such as a "life alert" or a fire alarm, when valuable life saving seconds are lost when sliding the door out of the way.

Another problem related do doors in intensive care units, may be that visitors, janitorial worker, interns, nurses and doctors all are touching the same lever handle to open the door before visiting the patient. Hence, infectious disease can quickly be spread from room to room.

It may also be desirable to allow or disallow unwanted visitors by keeping the door to an intensive care unit closed and locked, when only approved personnel should be allowed access to the intensive care unit.

Therefore, finding a way of controlling the doors in an intensive care unit, which mitigates or alleviates the above-mentioned drawbacks, would be most welcome.

SUMMARY OF THE INVENTION

With the above description in mind, then, one aspect of the present invention is to provide a way of controlling the doors in an intensive care unit, which seeks to mitigate, alleviate, or eliminate one or more of the above-identified deficiencies in the art and disadvantages singly or in any combination.

According to one aspect of the invention, it provides for an intensive care unit door control system for operating the door in an intensive care unit based on signals received from external units. Embodiments of the invention also relate to a method for controlling the doors in such a system. For example, in one embodiment, the invention relates to a door management system for an intensive care unit comprising at least two automatic intensive care unit doors, at least one control unit, said control unit being configured to receive signals from at least one external device; wherein the control unit is configured to control the opening and closing of the automatic intensive care unit doors based on the received signals.

In another embodiment, the door management system comprises a control terminal for inputting information into the system.

In another embodiment, the door management system comprises a plurality of control units, each control unit being adapted to control one intensive care unit door.

In another embodiment, the door management system comprises a central control unit adapted to control all doors.

In another embodiment, the at least one external unit is a sensor, a switch, a reader or a fire detection system.

In another embodiment, a door management system is provided wherein at least one signal is received from a medical device that alerts medical personnel that a patient requires care.

In another embodiment, the control unit is further adapted to receive at least one internal signal.

In another embodiment, the at least one internal signal is a signal from a senor, a switch or a reader.

In another embodiment, the intensive care unit door has a positive latch function.

According to aspects of the invention, a method is also provided for operating the doors in an intensive care unit door, comprising at least two automatic intensive care unit doors and at least one control unit, comprising the steps of receiving in said at least one control unit at least one signal from a first external device; and controlling by said at least one control unit the opening and closing of the automatic intensive care unit doors based on the received signals.

In another embodiment, the method comprises receiving information from a control terminal.

In another embodiment, the method comprises providing a plurality of control units which control one intensive care unit door each.

In another embodiment, the method comprises providing a central control unit which controls all doors in the intensive care unit.

In another embodiment, the method comprises providing at least one external unit which is a sensor, a switch, or a reader.

In another embodiment, the method comprises providing at least one received signal which is a signal from a fire detection system.

In another embodiment, the method comprises providing at least one received signal which is a signal from a medical device that alerts medical personnel that a patient requires care.

In another embodiment, the method comprises receiving at least one internal signal.

In another embodiment, the method comprises providing at least one internal signal which is a signal from a sensor, a switch or a reader.

In another embodiment, the intensive care unit door has a positive latch function.

By providing a system wherein the doors may be touchlessly controlled, via sensors, switches, readers or remote controllers, the spread of infectious diseases in the hospital may decrease.

By controlling the door opening by signals from medical equipment alerting medical personnel about a life threatening condition, the doors may be automatically slid out of the way and valuable seconds may be saved.

Furthermore, the possibility to centrally control the doors of a ward individually or simultaneously may save time for the medical personnel in many situations. By controlling the doors using remote controls, a patient may open and unlock the door to his room without assistance.

BRIEF DESCRIPTION OF THE DRAWINGS

Further objects and features, of the present invention will appear from the following detailed description of embodiments of the invention, wherein the embodiments will be described in more detail with reference to the accompanying drawings, in which.

It should be added, that the following description of the embodiments is for illustration purposes only and should not be interpreted as limiting the invention exclusively to these embodiments/aspects.

DETAILED DESCRIPTION

Embodiments of the present invention relate to an automatic intensive care unit door and to an intensive care unit door control system. The invention also relates to a method for operating an automatic intensive care unit door.

Embodiments of the present invention will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference signs refer to like elements throughout.

Figure 1B:
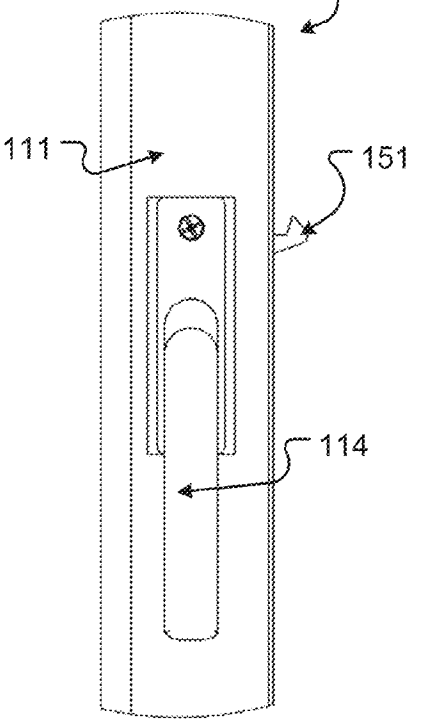
FIG.1b PRIOR ART
FIG. 1*a* shows a manual intensive care unit door package according to prior art and FIG. 1*b* shows a manual latch.
Figure 1A:
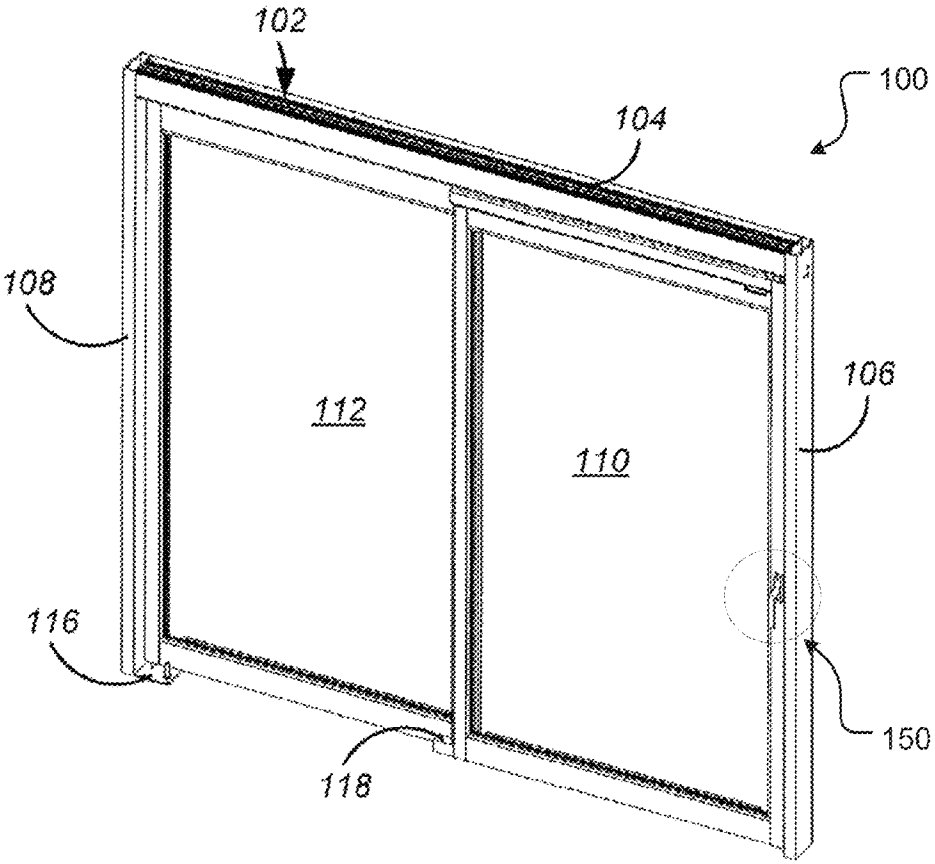
FIG.1a PRIOR ART

FIG. 1*a* shows a manual intensive care unit door package 100 according to prior art.

An intensive care unit referred to in this application may e.g. be an intensive care unit (ICU), a critical care unit (CCU) or an intensive therapy unit (ITU). In particular, an intensive care unit refers to a unit in a hospital containing the equipment, medical and nursing staff, and monitoring devices necessary to provide intensive care. However, the 'intensive care unit door control system' could also be used for related units, where the requirements on patient monitoring and cleanliness are similar e.g. infectious disease isolation rooms.

An intensive care unit may comprise one or several wards. Each ward may comprise one or several rooms. Each room typically has at least one intensive care unit door package.

As can be seen in FIG. 1, the door package 100 includes a frame 102 that has a top portion 104, a right jamb 106 and a left jamb 108. The frame 102 can be made of any conventional material that is used for manufacturing door frames, as is well known to those of ordinary skill in the art.

Inside the frame 102 is a door with two door panels; a right door panel 110 and a left door panel 112. This type of door is often referred to as a two-panel single slider package. It should be noted that while FIG. 1 shows two door panels, in some embodiments the door can be a so-called telescopic door, that is, a door containing three (or more) door panels. In fact, for some applications a three-panel telescopic door may actually be more desirable than a two-panel slider, as the three-panel telescopic door offers a larger clear door opening (CDO) compared to a two-panel slider for a door package of the same size. In the illustrated embodiment, the right door panel 110 can slide behind the left door panel 112 along tracks that are located in the top portion 104 of the frame 102. Of course, as the skilled person realizes, depending on different embodiments, the door package 100 can also be configured such that the left door panel 112 slides behind the right door panel 110. It should further be noted that there are no tracks on the floor in which the right door panel 110 can slide. That is, the door package (100) is a trackless door package 100. However, the invention may as well be implemented using tracks or wheels or any combination thereof.

Attached to the right door panel 110 is a latch 150 that can positively latch into the right jamb 106. The latch handle 114 protrudes from either side of the right door panel 110 and can be gripped by a person and rotated slightly to unlatch the right door panel 110 from the right jamb 106. While holding the handle 114, the person can slide the right door panel 110 behind the left panel 112 to achieve a maximum clear door opening (CDO) of the door in relation to its package size.

FIG. 1*b* shows the latch 150 in more detail. The latch 150 comprises an L-shaped latch hook 151 and a handle 114. A lever, not shown, transfers movement from the handle 114 to the latch hook 151. A spring is adapted to apply a spring force on latch hook 151 in a vertical direction.

The latch hook 151 is adapted to engage with a strike plate, when the door 110 is closed. Thereby a positive latch function is achieved.

Figure 2:
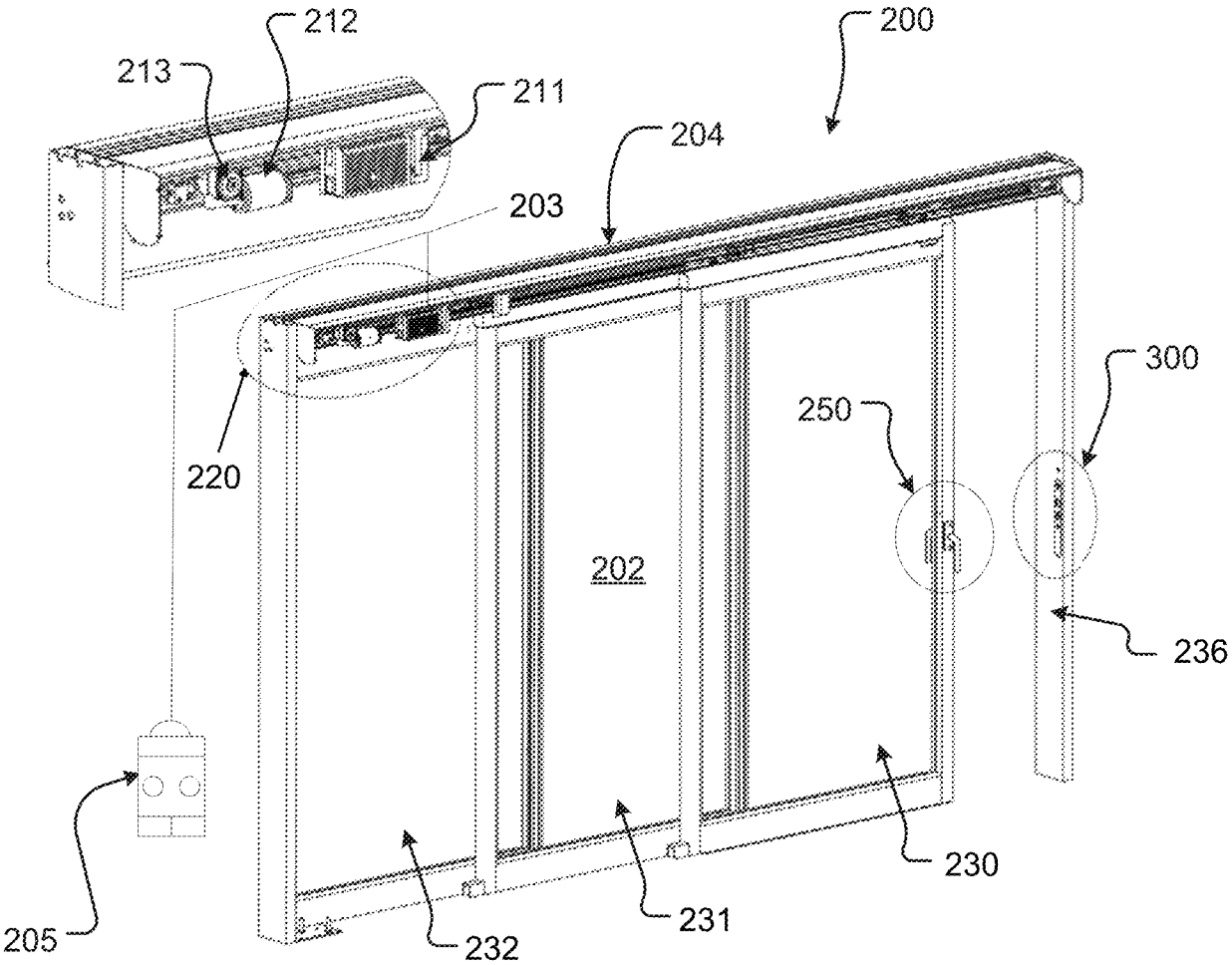
FIG. 2 shows an automatic intensive care unit door package.

FIG. 2 shows an overview of an automatic intensive care unit door package 200. An automatic door is a self-opening door, i.e. a door, which may be opened without using manual force. The opening is in most cases electric, i.e. performed by an electric motor.

The door package 200 comprises a door 202 comprising three door panels, a left door panel 232, a middle door panel 231 and a right door panel 230. Attached to the right door panel 230 is a latch 250 that can positively latch into the right jamb 236. The automatic intensive care unit door package 200 is constructed in the same manner as the manual intensive care unit door package described in relation to FIG. 1 except for the difference that an automation kit is installed. An automation kit may be installed in the factory. An automation kit may also be retrofitted to an already installed door.

The automation kit comprises e.g. a control unit 211, an automated strike 300 and drive means 220.

The control unit 211 is connected to an internal switch 205 and to an external signal 203. The control unit 211 controls the operation of the automatic intensive care unit door package 200, based on the received signals.

The drive means 220 is located in the top portion 204 of the frame and comprises a tooth belt and a drive wheel, not visible, a gear box 213 and an electrical motor 212. The drive means 220 are adapted to open and close the door 202.

Due to the requirement on the intensive care unit door to have a positive latch function, an automatic intensive care unit door requires a latch, which may be operated both manually and automatically. The automated strike 300 operates together with the manual latch 250, which is the same latch 150 used in the manual door, shown in FIG. 1*b*. The automated strike 300 enables automatic releasing of the latch 250. The automated strike 300 is described in detail in FIGS. 3*a* to 3*b*.

Figure 3A:
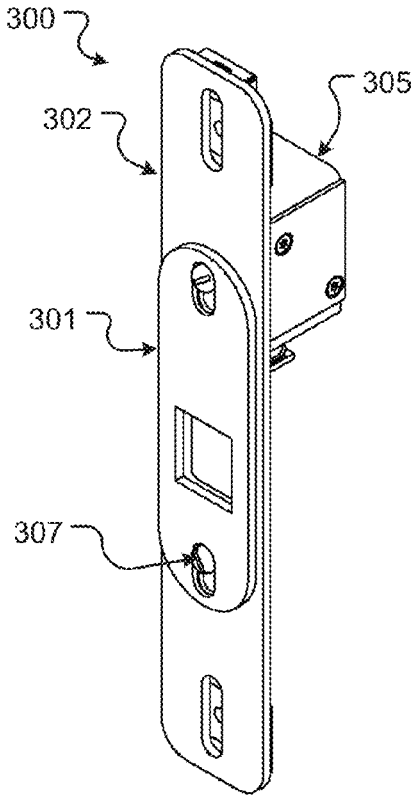
FIGS. 3*a* and 3*b* show an automated strike.
Figure 3C:
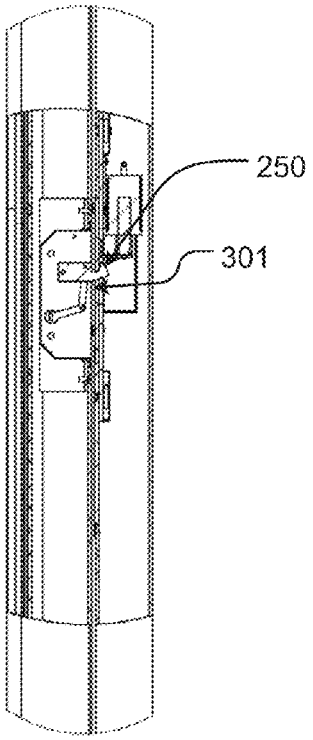
FIG. 3*c* shows the manual latch disclosed in FIG. 1*b* in cooperation with the automated strike.
Figure 3B:
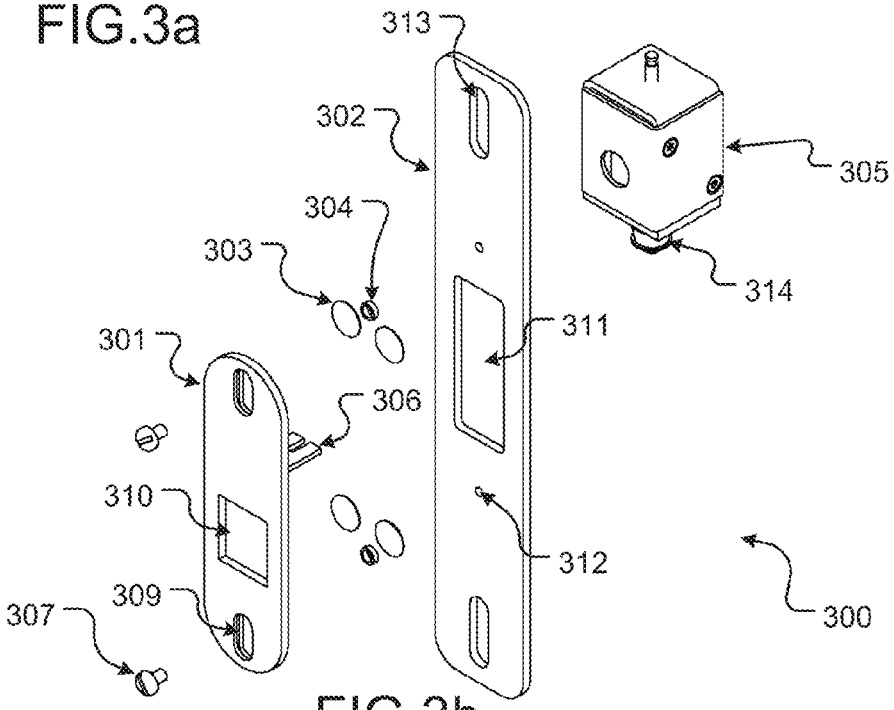

FIGS. 3*a* and 3*b* disclose a strike, which allows a sliding door to function both in a manual mode and in an automatic mode. Thereby, a positive latch, which may be automatically operated, is provided. The automated strike 300 may cooperate with the latch 150 described in FIG. 1*b*.

The automated strike 300 comprises a strike plate 301, a back plate 302, plastic discs 303, a strike spacer 304, a solenoid assembly 305, a strike connector 306 and mounting screws 307.

The strike plate 301 is an oblong flat piece made of e.g. metal. The strike plate is shown from the side in FIG. 3*c*. The strike plate has a central aperture 310. The strike plate has two slots 309 extending along the oblong strike plate 301. The slots are adapted to mount the strike plate 301 to a back plate 302. The slots 309 are positioned one at each end portion of the strike plate 301, with the central aperture 310 in between. The slots 309 in the strike plate 301, are arranged to allow the automatic movement up/down of the strike plate 301 in relation to the back plate 302. These slots 309 may e.g. be 6.4×17.4 mm with a 8.4×17.4×1.5 mm counter bore to accommodate a strike spacer 304 and screws 307 e.g. M4 pan head machine screws, that fastens the strike plate 301 to the back plate 302.

The back plate 302 is also an oblong flat piece of e.g. metal. The back plate 302 has a central aperture 311, two holes 312 and two slots 313. The slots 313 are adapted to mount the strike plate 301 to the door jamb 236. The slots extend along the back plate 302 to allow for adjustment of the entire automated strike 300 to correspond with the vertical position of the door 202. The holes 312 are adapted to receive the screws 307.

The strike connector 306 is a piece of metal extending perpendicularly from the strike plate 301 towards the back plate 302 and through the central aperture 311 of the back plate 302. The strike connector is adapted to be connected to a core 314, which cooperates with a solenoid, not shown in order to move the strike plate 301. The strike connector 306 is attached to the strike plate 301 by welding. It may also be bonded or attached with screws; in this embodiment, welding is preferred to achieve the design goal of eliminating exposed fasteners.

The strike plate 301 is slidably attached to the back plate 302. Hence, when mounted, the strike plate 301 may be slided in a vertical direction in order to disengage the latch hook 151.

Between the strike plate 301 and the back plate 302, there are strike spacers 304 and plastic discs 303 e.g., 4 self-adhesive UHMW discs 12.7 mm diameter X .012 thickness, to prevent noise and reduce friction, when sliding the strike plate 301. The same result may be accomplished using grease or some type of bearing.

The solenoid assembly 305 comprises a solenoid, not shown, and a core 314 positioned inside the solenoid. The solenoid and core 314 are used to move the strike plate 301 in a vertical direction. The solenoid assembly 305 is attached to the back side of the back plate 302, i.e. inside the door jamb 236. Thereby, the core 314 is positioned right above the strike connector 306, such that it can be connected to the strike connector. The solenoid is activated by a 12 VDC current supplied from an external power source, not shown. When the solenoid is activated, the core 314 moves in a vertical direction, due to the magnetic field created by the solenoid.

FIG. 3*c* shows the latch 250 in engagement with the strike plate 301. When the latch has cleared the central aperture 310 a spring pulls it upwards and a vertical limb of the latch hook 151 engages with the back side of the strike plate 301. The back side refers to the side facing the door jamb 236.

In the manual mode the latch hook 151 can be disengaged from the strike plate 301 by rotating the latch handle 114 and thereby moving the latch hook 151 downwards, such that the vertical limb of the latch hook 151 can move under the upper edge of the central aperture 310. Thereby the door is unlatched.

In the automatic mode the automated strike 300 may be released by sliding the strike plate 301 over the latch hook 151. This is possible as the strike plate 301 is slidable in a vertical direction in relation to the back plate 302 and because the strike comprises driving means for driving the strike plate. As the back plate is fixed mounted to the door jamb 236, the strike plate 301 is slidable in relation to the door jamb 236 and to the latch hook 151 as well. The operation of the automatic door package will be further described in relation to FIG. 4 and FIG. 5.

The method for operating the door 202 shown in FIG. 2 is now described in more detail with reference to FIGS. 4 and 5.

Figure 4:
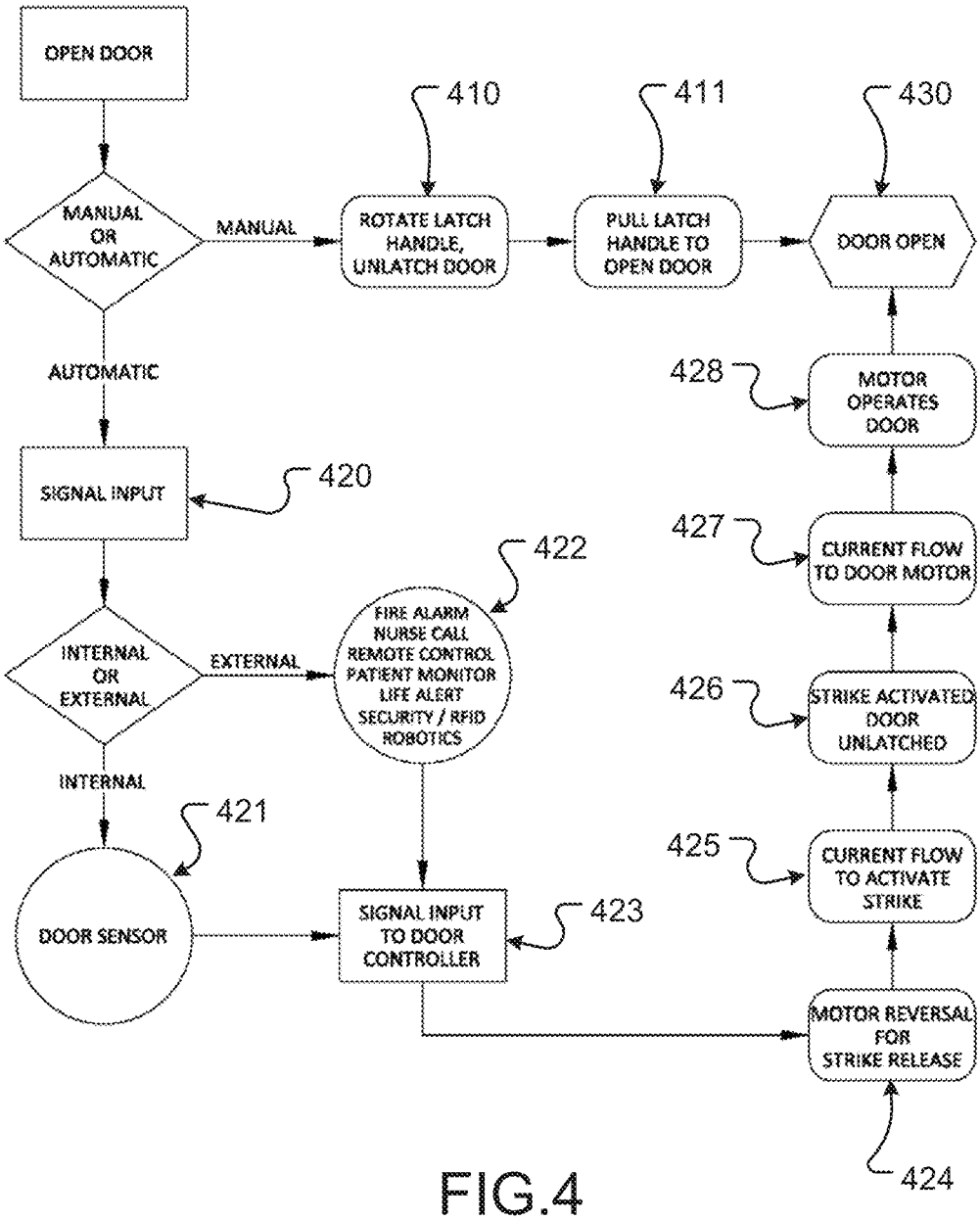
FIG. 4 illustrates in a flow chart a method for opening an automatic intensive care unit door.

FIG. 4 illustrates a method for opening a door 202 in an intensive care unit. The door 202 may be opened manually or automatically.

The manual opening manually is initiated by step 410 wherein a person manually rotates the handle 114 in order to unlatch the door 202. When the latch is released the person moves the right door panel 110 towards its open position by pulling the handle 114, step 411. The manual opening of the door may be assisted by the electric motor 212. When the right door panel 230 and the middle door panel 231 is completely behind the left door panel 232 the door is open 430.

The automatic opening is triggered by a signal input 420. The signal may be internal 421 or external 422. When receiving the signal to open a door the central control unit 601 (described in FIG. 6) sends an input to the local control unit 211 of the door package or packages 200 concerned, step 423. When the control unit 211 receives a signal to open the door, the motor 212 briefly (milliseconds) runs in the reverse (closing) direction to remove any pressure on the latch 250, step 424. The control unit 211 activates a current flow through the driving means, i.e. solenoid of the strike 300, step 425. Thereafter, the latch 250 is released and the door 202 is unlatched, step 426. The control unit 211 then activates a current flow to the motor 212, step 427. The motor 212 operates the door 202 and drives the right door panel 230 and middle door panel 231 towards its open position, step 428. When the right door panel 230 and the middle door panel 231 is completely behind the left door panel 232 the door is open 430.

Figure 5:
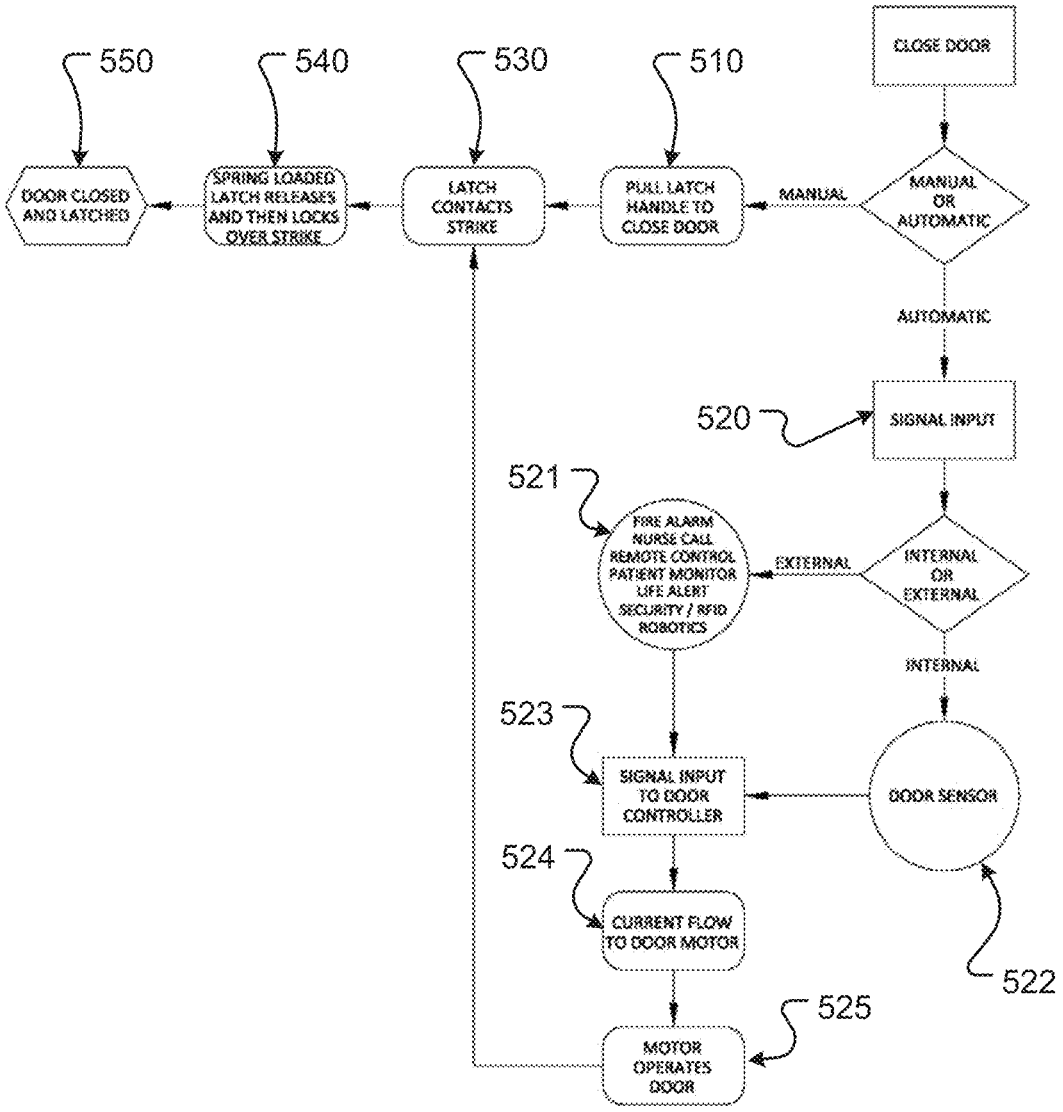
FIG. 5 illustrates in a flow chart a method for closing an automatic intensive care unit door.

FIG. 5 discloses a method for closing a door in an intensive care unit. The door may be closed manually or automatically.

The manual closing is initiated by step 510 where a person moves the right door panel 230 and middle door panel 231 by pulling the handle 114. The manual closing of the door may be assisted by the electric motor 212. When the door has reached its closed position, the latch hook 151 contacts the strike plate 301, step 530. The spring loaded latch hook 151 then releases and locks over the strike plate 301 step 540. The door is then in a closed and latched position, 550.

The automatic closing is triggered by a signal input as disclosed in step 520. The signal may be internal 521 or external 522. When receiving the signal to close the door the central control unit 601 sends an input to the control unit 211, step 523. The control unit 211 activates a current flow to the motor 212, step 524. The control unit 211 operates the door and drives the door panel to its closed position, step 525. When the door reaches its closed position, the latch hook 151 contacts the strike plate 301, step 530. The spring loaded latch hook 151 then releases and locks over the strike plate 301 step 540. The door is then in a closed and latched position, 550.

In automatic mode, the strike plate 301 may as an alternative stay in its unlatched position during the entire cycle. When the door 202 has reached its closed position, the power to the solenoid is dropped and the strike plate 301 slides over the latch hook 151. Thereby, the vertical limb of the latch hook 151 engages with the back side of the strike plate 301 and the door is closed and latched.

Figure 6:
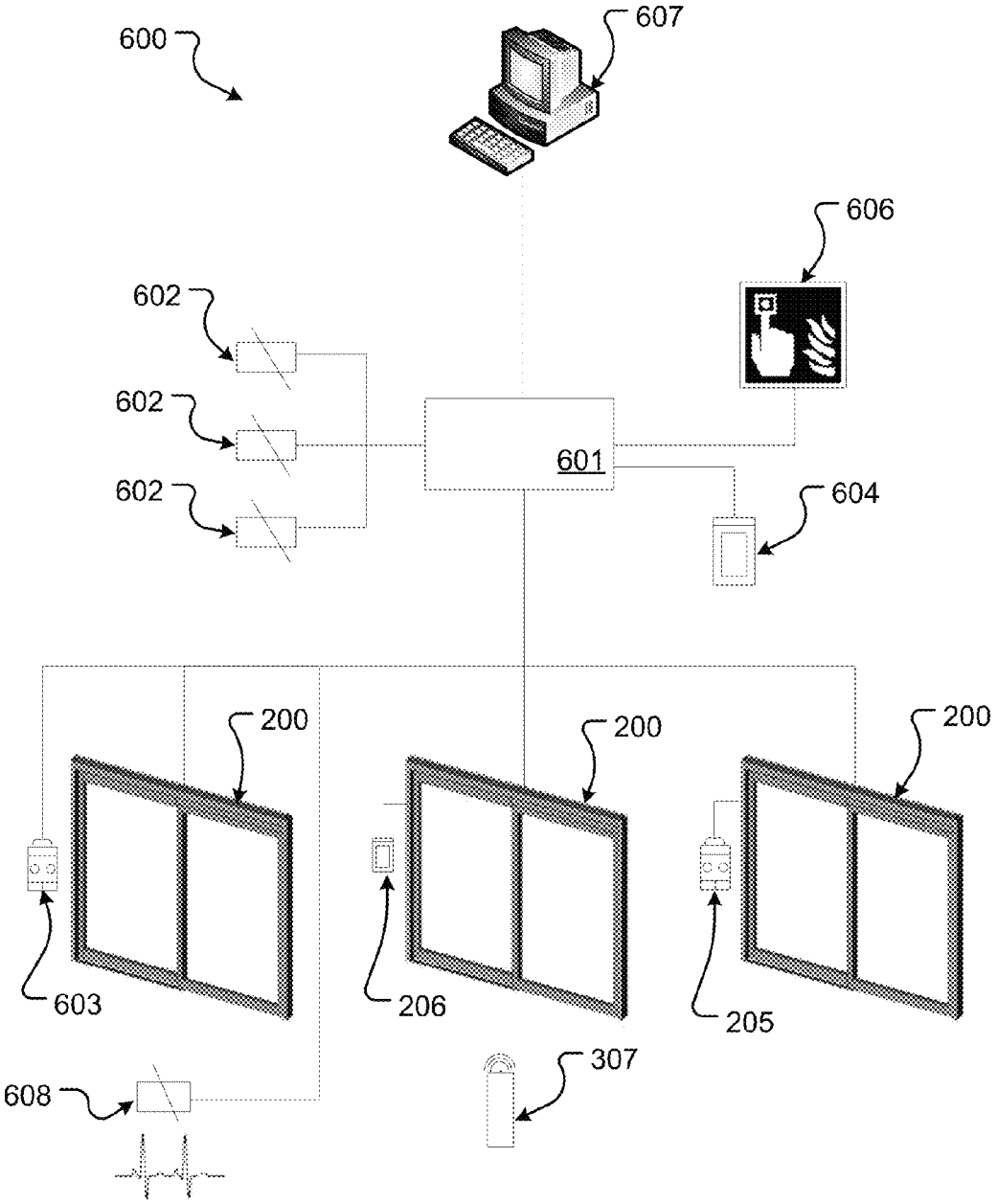
FIG. 6 illustrates a centralized intensive care unit door control system.

FIG. 6 discloses a centralized system 600 for operating the doors 202 in an intensive care unit. The system comprises three automatic intensive care unit door packages 200, a central control unit 601 and a number of external units. The central control unit 601 receives signals from the external units, whereupon the control unit reacts in order to control the doors of the intensive care unit.

External units are sensors 602, 608, readers 604, push switches 603, a fire detection system 606 or a control terminal 607. The sensor may be an EKG sensor 608 or other medical device that may alert medical personnel that a patient requires care. The sensors 602 may also be proximity sensors or any kind of sensors. The central control unit 601 may also be connected to any kind of switches 603 or readers 604 for controlling the operation of the doors in the system.

The central control unit 601 reacts on pre programmed signals or alarms e.g. the doors may be automatically opened at a specific time, e.g. when it is time for a round or meal service.

The central control unit 601 is connected to each intensive care unit door 202 in the intensive care unit. The central control unit is configured to send signals to the control unit 211 of each door 202 in order to automatically control the opening or closing of the door 202.

The central control unit 601 may control each door 202 in the system 600 individually. The central control unit 601 may also open or close all or several of the doors 202 in the system simultaneously, e.g. for meal service or for a medical round.

The central control 601 unit may also activate and deactivate locking of the doors 202. Thereby only approved personnel will be allowed access through means of e.g. readers 604 such as card readers, proximity readers, key code access readers, security readers, thumb readers. This is especially important for small children.

The system may also allow individual control of each door in the intensive care unit, by an internal unit. An internal unit refers to a unit only controlling one specific door in the system, e.g. a switch 205, reader 206 or by a remote control 307. The internal units e.g. readers 206 may also be configured to lock or unlock each door 202 individually.

The central control unit 601 is connected to a control terminal 607. The terminal is used to input pre-programmed alarms and to program settings for controlling the operation of the intensive care unit door operation system. The control terminal 607 may also be used to input commands to directly control the doors 202.

The switches 603, 205 may be mechanical push switches, electrical mechanical push switches, electrical mechanical "wave" touch less switches.

Figure 7:
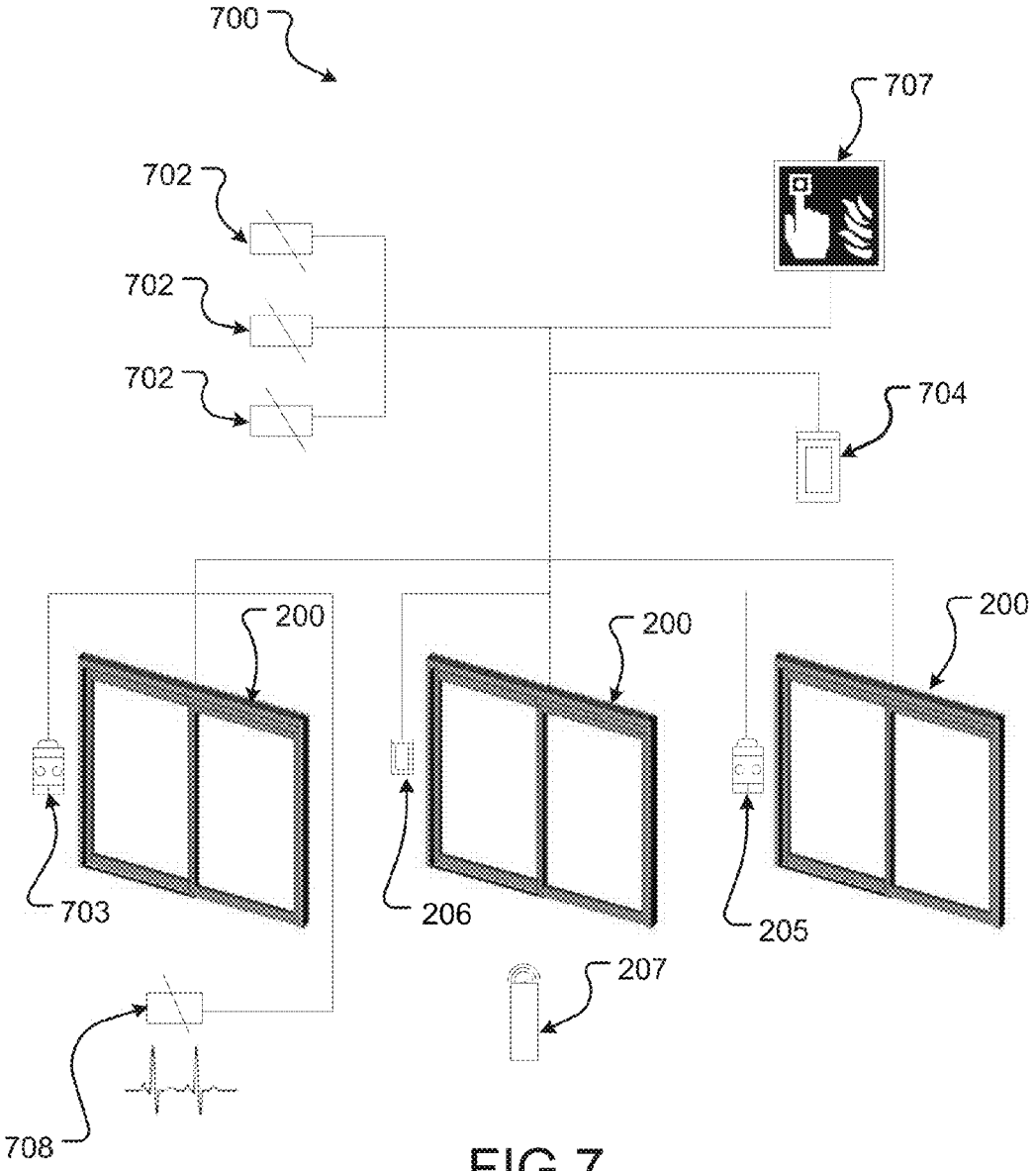
FIG. 7 illustrates a distributed intensive care unit door control system.

FIG. 7 discloses a distributed system 700 for operating the doors 202 in an intensive care unit. The system comprises three automatic intensive care unit door packages 200, each comprising a control unit 211, and a number of external units. Each control unit 211 receives signals from the external units, whereupon each control unit 211 reacts in order to control respective door 202.

External units are sensors 702, 708, readers 704, push switches 703 or a fire detection system 707. The sensor may be an EKG sensor 708 or other medical device that may alert medical personnel that a patient requires care. The sensors 702 may also be proximity sensors or any kind of sensors.

The control units 211 reacts on pre programmed signals or alarms e.g. the doors may be automatically opened at a specific time, e.g. when it is time for a round or meal service.

The control units 211 may also activate and deactivate locking of the doors 202 based on particular signal inputs. Thereby only approved personnel will be allowed access through means of e.g. readers 704 such as card readers, proximity readers, key code access readers, security readers, thumb readers. This is especially important for small children.

The system may also allow individual control of each door in the intensive care unit, by an internal unit. An internal unit refers to a unit only controlling one specific door in the system, e.g. a switch 205, reader 206 or by a remote control 207. The internal units e.g. readers 206 may also be configured to lock or unlock each door 202 individually.

The switches 703, 205 may be mechanical push switches, electrical mechanical push switches, electrical mechanical "wave" touch less switches.

FIGS. 6 and 7 disclose two examples of how different sensors, switches and scanners may be connected in a system for operating the doors in an intensive care unit. However, it must be assumed that the design of the system may be adapted for the particular needs in a certain situation. Hence, the sensors, switches and scanners may be selected and placed based on the needs in a specific intensive care unit. Furthermore the control of a particular intensive care unit may also be programmed dependent on the routines and needs in the particular system. Furthermore many other different signals may cause the control unit to open or close one or several doors 202 in the systems 600, 700.

Figure 8A:
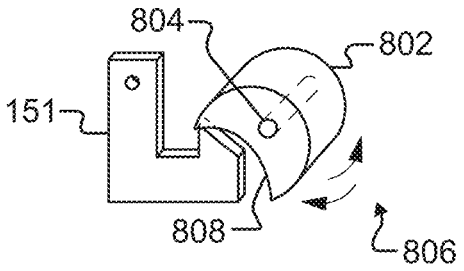
FIGS. 8A and 8B show another embodiment of an automated strike incorporating a partial cylinder.
Figure 8B:
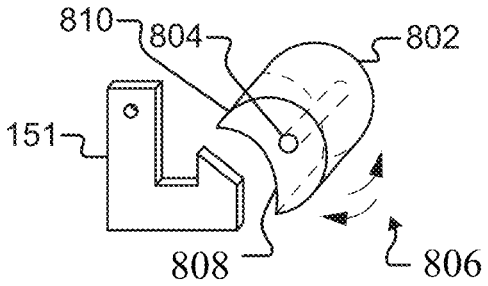

FIGS. 8A and 8B illustrate another embodiment of automated strike 300 working in cooperation with latch 150 in a manual and/or automated fashion. In this embodiment, instead of utilizing a sliding strike plate 301, a partial cylinder 802 is provided for engagement with the latch hook 151. The partial cylinder 802 rotates about a central axis 804 as indicated by arrows 806. The partial cylinder 802 has a fully or partially hollow interior 808 and a leading edge 810 formed along its axial width. The latch hook 151 is designed to engage positively with the leading edge 810. FIG. 8A shows the latched position with latch hook 151 positioned partially within the interior 808 of the cylinder 802 and engaged with leading edge 810. FIG. 8B shows an unlatched position with cylinder 802 rotated clockwise (as illustrated in the Figure) relative to the position shown in FIG. 8A, thus freeing latch hook 151 from engagement with leading edge 810. When sliding door 230 moves from an open to a closed position, the latch hook 151 is configured to deflect downwardly and pass under leading edge 810 of the cylinder 802. Partial cylinder 802 may be rotated in a variety of ways, e.g., electric solenoid, pneumatically, hydraulically, induction motor, or via a cable connected to a remote motor. Latch handle 114 may also manually move latch hook 151 away from engagement with partial cylinder 802.

Figure 9A:
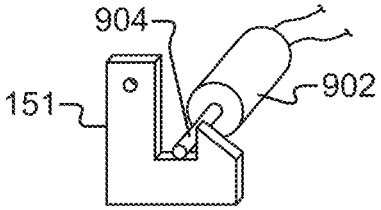
FIGS. 9A and 9B show another embodiment of an automated strike incorporating a solenoid-and-pin in a horizontal orientation.
Figure 9B:
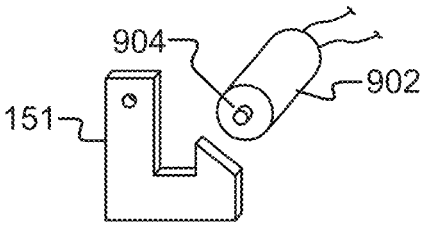

FIGS. 9A and 9B illustrate another embodiment of automated strike 300 working in cooperation with latch 150 in a manual and/or automated fashion. In this embodiment, a solenoid 902 with a movable core 904 replaces the sliding strike plate 301. The solenoid 902 is positioned to the side of latch hook 151. FIG. 9A shows the latched position with the core 904 of the solenoid 902 in an extended position to block withdrawal of the latch hook 151. FIG. 9B shows the unlatched position with the core 904 retracted by solenoid 902 to free latch hook 151. Core 904 may be of any suitable shape instead of round to block withdrawal of the latch hook 151. Instead of a utilizing an electric solenoid 902 to move core 904, the core 904 or a similar rigid element may be moved in a variety of ways, e.g., pneumatically, hydraulically, induction motor, or via a cable or linkage connected to a remote motor. Latch handle 114 may also move latch hook 151 away from engagement with core 904.

Figure 10A:
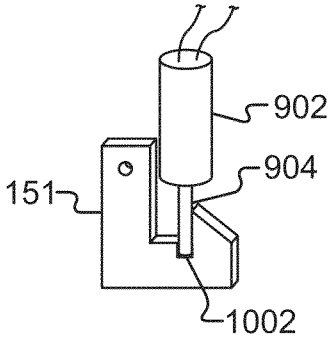
FIGS. 10A and 10B show another embodiment of an automated strike incorporating a solenoid-and-pin in a vertical orientation.
Figure 10B:
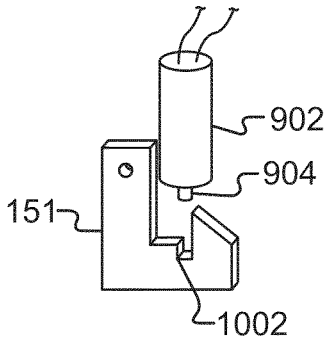

FIGS. 10A and 10B illustrate an alternative orientation of the solenoid 902. Here, the solenoid 902 is positioned vertically above latch hook 151. In this embodiment, an aperture or slot 1002 is formed in latch hook 151. FIG. 10A shows the latched position with core 904 extended downward and seating itself in aperture 1002 of latch hook 151. FIG. 10B shows the unlatched position with core 904 retracted out of aperture 1002 by solenoid 902 to free latch hook 151. In this embodiment, latch hook 151 and core 904 may have more increased width imparted to them, compared to other embodiments described herein, to make a more secure engagement. Core 904 may be of any suitable shape instead of round to better engage with the width of aperture 1002. Instead of using an electric solenoid 902, the core 904 or similar rigid element may be moved in and out of aperture 1002 in a variety of ways, e.g., pneumatically, hydraulically, induction motor, or via a cable or linkage connected to a remote motor. Latch handle 114 may manually move latch hook 151 away from engagement with pin 902.

Figure 11A:
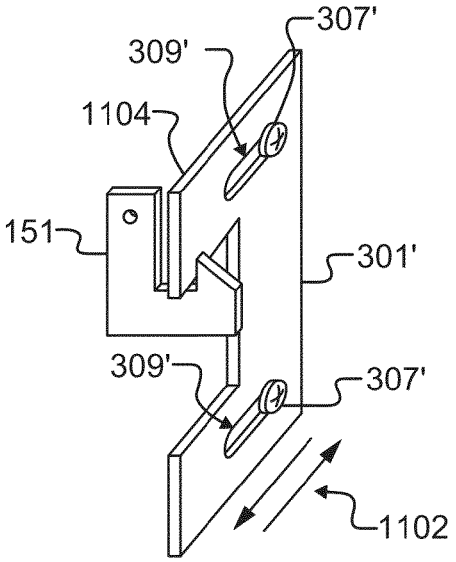
FIGS. 11A and 11B show another embodiment of an automated strike incorporating a "C"-shaped strike plate.
Figure 11B:
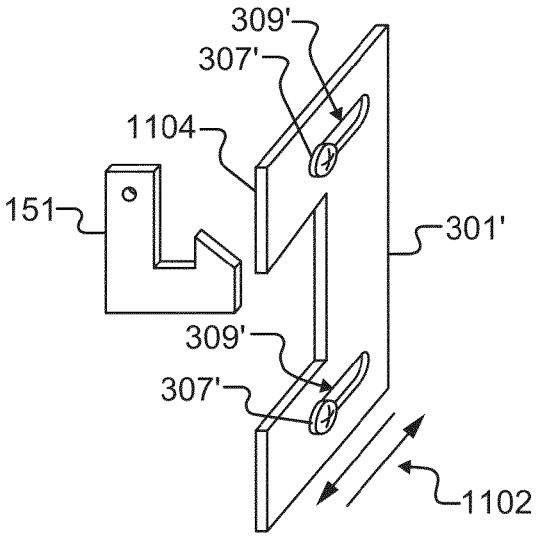

FIGS. 11A and 11B illustrate another embodiment of automated strike 300 working in cooperation with latch 150 in a manual and/or automated fashion. In this embodiment, strike plate 301' slides laterally as indicated by arrows 1102 rather than vertically as described above with respect to FIGS. 3*a*, 3*b*, and 3*c*. Strike plate 301' has two slots 309' extending horizontally along the top and bottom of strike plate 301'. The slots are adapted to mount strike plate 301' to a back plate in a manner similar to that describe above in connection with FIGS. 3*a*, 3*b*, and 3*c* Screws 307' fasten strike plate 301' to a back plate. In this embodiment, FIG. 11A shows the latched position with latch hook 151 engaged with top leg 1104 of strike plate 301'. FIG. 11B shows the unlatched position with strike plate 301' retracted to free latch hook 151. Strike plate 301' may be moved laterally with any of the mechanisms in the ways discussed above. Latch handle 114 may manually move latch hook 151 away from engagement with top leg 1104 of strike plate 301'.

Figure 12A:
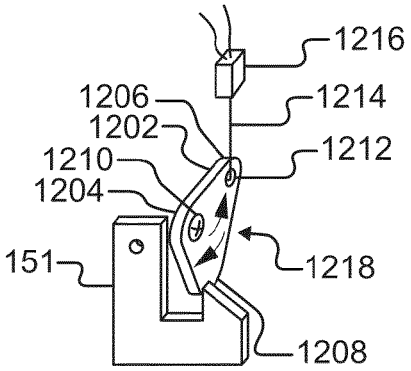
FIGS. 12A and 12B show another embodiment of an automated strike incorporating a pivoting strike plate.
Figure 12B:
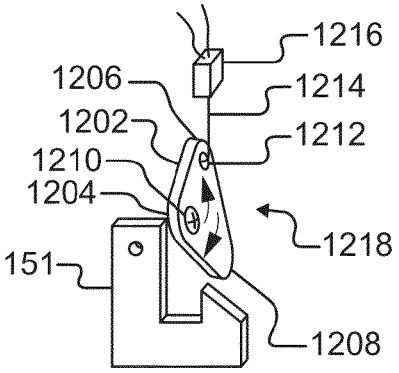

FIGS. 12A and 12B illustrate another embodiment of automated strike 300 working in cooperation with latch 150 in a manual and/or automated fashion. In this embodiment, pivoting strike plate 1202 is generally triangular in shape with first corner 1204 and second corner 1206 oriented above third corner 1208 forming an inverted triangle. Pivot point 1210 is located near first corner 1204. A hole 1212 located near second corner 1206 receives a link 1214 that is connected to a solenoid 1216. Extending and retracting the core of the solenoid 1216 causes the link 1214 to pivot or rotate strike plate 1202 about pivot point 1210 in the directions indicated by arrows 1218. FIG. 12A shows the latched position with third corner 1208 blocking withdrawal of latch hook 151. FIG. 12B shows the unlatched position with link 1214 in the retracted position which causes third corner 1208 to rotate away from latch hook 151. Instead of using an electric solenoid 1216, the link 1214 or similar rigid element may be moved in a variety of ways, e.g., pneumatically, hydraulically, induction motor, or via a cable connected to a remote motor. Latch handle 114 may manually move latch hook 151 away from engagement with third corner 1208 of pivoting strike plate 1202.

According to one aspect of the invention a fire alarm or lock down type emergency signal automatically closes and/or electrically latches one or several doors 202. Smoke packages certified under Underwriters Laboratories standard 1784 (UL1784) that are held open either by the patient, nurse or control system can automatically close and electrically latch to prevent smoke infiltration during a fire alarm, yet still retain the mechanical manual levers for egress.

According to one aspect of the invention a "code" or "life alert" type emergency response automatically opens the door prior to emergency personnel arrival. If the patient is having an emergency and there is a signal sent to the automatic door operator, it can open the door prior to the arrival of the emergency personnel in order to save valuable life saving seconds by sliding the door out of the way.

According to one aspect of the invention a nurse call signal automatically opens the door. Hence, if the patient calls the nurse, the door opens prior to their arrival.

According to one aspect of the invention a remote control signal generated by patient and/or nurse may automatically opens or closes the door. Patients or nurses can have a hand held remote controls, or remote located control to control the opening or closing of the doors.

According to one aspect of the invention a signal indicating a round or meal service may automatically open all doors in a given intensive care unit.

According to one aspect of the invention, a touchless sensor may open a door—given that family visitors, janitorial worker, interns, nurses and doctors all are touching the same lever handle to open the door before working with the patient, infectious disease can quickly be spread from room to room. Touchless automation will allow this door to open by just a wave of the hand or close proximity to the door in order not to spread germs and disease to already weaken patients.

The foregoing has described the principles, preferred embodiments and modes of operation of the present invention. However, the invention should be regarded as illustrative rather than restrictive, and not as being limited to the particular embodiments discussed above. The different features of the various embodiments of the invention can be combined in other combinations than those explicitly described. It should therefore be appreciated that variations may be made in those embodiments by those skilled in the art without departing from the scope of the present invention as defined by the following claims.

What is claimed is:

1. An intensive care unit door management system comprising:

a. a first automatic intensive care unit door associated with a first door opening;

b. a second automatic intensive care unit door associated with a second door opening;

c. a first control unit associated with the first and second automatic intensive care unit doors, said control unit being configured to receive signals from at least one external device;

d. a signal generated by a first external device that is a first medical device corresponding to the medical condition of a first patient measured by the first medical device, the first patient associated with the first automatic intensive care unit door, wherein the first control unit is configured to control the opening and closing of the first automatic intensive care unit doors based on at least one received signal generated by the first medical device corresponding to the medical condition of the first patient; and e. a signal generated by a second external device that is a second medical device corresponding to the medical condition of a second patient measured by a second medical device, the second patient associated with the second automatic intensive care unit door; wherein the first control unit is configured to control the opening and closing of the second automatic intensive care unit door based on at least one received signal generated by the second medical device corresponding to the medical condition of the second patient.

2. A door management system according to claim 1, further comprising a control terminal for inputting information into the system.

3. A door management system according to claim 1, wherein the system comprises a second control unit, the second control unit being adapted to control the second automatic intensive care unit door.

4. The door management system according to claim 3, wherein the first and second control units are adapted to receive at least one signal from at least one external unit different from a medical device corresponding to the medical condition of a patient.

5. A door management system according to claim 4, wherein the external unit comprises at least one of a sensor, a switch or a reader, none of which correspond to a medical condition of a patient.

6. A door management system according to claim 4, wherein the external unit comprises a fire detection system.

7. The door management system according to claim 3, further comprising a central control unit in communication with the first and second control units, and wherein the central control unit controls the operation of the first and second control units.

8. The door management system according to claim 7, wherein the central control unit may operate the first and second control units independently or simultaneously.

9. A door management system according to claim 1, wherein the system comprises at least three automatic intensive care unit doors and the first control unit is adapted to control all automatic intensive care unit doors.

10. A door management system according to claim 1, further comprising a first internal unit associated with the first automatic intensive care unit door and a second internal unit associated with the second automatic intensive care unit door, and wherein the first control unit is further adapted to receive at least one internal signal from the first internal unit and from the second internal unit.

11. A door management system for according to claim 10, wherein the internal unit is at least one of a sensor, a switch or a reader associated with each automatic intensive care unit door.

12. A door management system according to claim 1, wherein the first and second automatic intensive care unit doors each have a positive latch function, the system further comprising means for overcoming the positive latch function to permit opening of the first and second automatic intensive care unit doors.

13. An intensive care unit door management system comprising:

a. a first automatic intensive care unit door associated with a first door opening and a first internal unit adapted to control the opening and closing of the first automatic intensive care unit door, wherein the first automatic intensive care unit door has an open state and a closed state;

b. a second automatic intensive care unit door associated with a second door opening and a second internal unit adapted to control the opening and closing of the second automatic intensive care unit door, wherein the second automatic intensive care unit door has an open state and a closed state;

c. a central control unit in communication with the first and second internal units and configured to receive signals from and send signals to the first and second internal units, and also configured to receive signals from at least one external device associated with the first and second automatic intensive care unit doors;

d. wherein the central control unit is configured to send at least one signal to the first and second internal units that causes the state of the first and second automatic intensive care unit door to change based upon a signal generated by the at least one external device.

14. The intensive care unit door management system of claim 13, wherein the at least one external device comprises, a. a first medical device corresponding to the medical condition of a first patient associated with the first automatic intensive care unit door measured by the first medical device; and b. a second medical device corresponding to the medical condition of a second patient associated with the second automatic intensive care unit door measured by the second medical device.

15. The intensive care unit door management system of claim 14, wherein the at least one external device further comprises, a. at least one of a sensor, a switch, a reader and a fire detection system associated with the first automatic intensive care unit door; and b. at least one of a sensor, a switch, a reader and a fire detection system associated with the second automatic intensive care unit door.

16. The intensive care unit door management system of claim 13, wherein the at least one external device comprises at least one of a sensor, a switch, a reader and a fire detection system.

17. The intensive care unit door management system of claim 13, wherein the first and second automatic intensive care unit doors each have a positive latch function, the system further comprising means for overcoming the positive latch function to permit opening of the first and second automatic intensive care unit doors.

18. A door management system according to claim 13, further comprising a control terminal for inputting information into the system.

* * * * *